US005847499A

United States Patent [19]

Rieppo et al.

[11] Patent Number: 5,847,499

[45] Date of Patent: Dec. 8, 1998

[54] APPARATUS FOR GENERATING MULTIPLE X-RAY IMAGES OF AN OBJECT FROM A SINGLE X-RAY EXPOSURE

[75] Inventors: Pia-Krista M. Rieppo; John A. Rowlands, both of Toronto, Canada

[73] Assignee: Sunnybrook Hospital, North York, Canada

[21] Appl. No.: 791,986

[22] Filed: Jan. 31, 1997

[51] Int. Cl.[6] ..... H01J 31/26

[52] U.S. Cl. ..... 313/365; 313/367; 313/366; 378/98.2; 378/98.3; 378/98.7; 378/98.8; 378/98.12; 378/19; 378/124

[58] Field of Search ..... 250/327.2, 484.1, 250/213 VT, 214 VT; 358/120; 378/19, 98.8, 98.2, 98.3, 98.7, 98.12; 349/124; 313/365

[56] References Cited

U.S. PATENT DOCUMENTS

| | | | |
|---|---|---|---|
| 4,350,893 | 9/1982 | Takahashi et al. | 250/484.1 |
| 4,368,386 | 1/1983 | Huignard et al. | 250/213 R |
| 4,471,378 | 9/1984 | Ng | 358/110 |
| 4,527,060 | 7/1985 | Suzuki et al. | 250/327.2 |
| 4,542,290 | 9/1985 | Tan et al. | 250/213 VT |
| 4,564,760 | 1/1986 | Noguchi et al. | 250/327.2 |
| 4,780,897 | 10/1988 | McDaniel et al. | 378/62 |
| 5,138,642 | 8/1992 | McCroskey et al. | 378/19 |
| 5,254,480 | 10/1993 | Tran | 437/2 |
| 5,306,907 | 4/1994 | Nudelman et al. | 250/214 VT |
| 5,315,631 | 5/1994 | Hillen et al. | 378/98.8 |
| 5,623,354 | 4/1997 | Lien et al. | 349/124 |

OTHER PUBLICATIONS

X–Ray Imaging With Amorphous Selenium: Liquid Crystal Light Valve For X–Ray Imaging Medical Physics, vol. 21, No. 8, Aug., 1994, pp. 1362 6–A–7.

X–Ray–Imaging–Chairman: Ian Cunningham Medical Physics, vol. 20, No. 5, Sep./Oct. 1993, p. 1587.

An Amorophous Selenium Liquid Crystal Light Valve For X–Ray Imaging 228/SPIE vol. 2432 (no date).

*Primary Examiner*—Ashok Patel
*Assistant Examiner*—Matthew J. Gerike
*Attorney, Agent, or Firm*—Fay, Sharpe, Beall, Fagan, Minnich & McKee

[57] ABSTRACT

An x-ray image intensifier includes a photoconductive x-ray detector having an electro-optic light modulator disposed on a photoconductive detector layer. The photoconductive x-ray detector absorbs x-rays passing through an object to be imaged to form an x-ray exposure of the object. An optical image of the x-ray exposure is generated when light passes through the photoconductive x-ray detector. An imager captures optical images of the x-ray exposure. A processor coupled to the imager digitizes and stores the optical images of the x-ray exposure captured by the imager at selected intervals.

22 Claims, 5 Drawing Sheets

APPARATUS FOR GENERATING MULTIPLE X-RAY IMAGES OF AN OBJECT FROM A SINGLE X-RAY EXPOSURE

FIELD OF THE INVENTION

The present invention relates to radiation imaging and in particular to an x-ray image intensifier and a method of x-ray imaging.

BACKGROUND OF THE INVENTION

Radiographic imaging systems have typically made use of phosphor screens onto which x-rays, passing through a patient to be imaged, impinge. Conventionally, the phosphor screen image has been used to expose a photographic film. However, over recent years, a trend towards digital imaging has developed.

One known prior art digital radiographic imaging system is based on film image digitization. This radiographic imaging system separates the display and detection medium and allows for electronic manipulation, storage and transfer of radiographic images. However, film image digitization suffers from the same inconveniences as film handling and development and requires an additional step, making the radiographic imaging system cost and time inefficient. Furthermore, the quality of images generated by this radiographic imaging system is only as good as the original film image.

It has also been considered to couple optically a phosphor screen with an optical imaging system. Specifically, a lens is used to couple the phosphor screen to an optical imager in the form of a charge-coupled device (CCD) camera. The output of the CCD camera is fed to a processor which digitizes and displays the image captured by the CCD camera.

Unfortunately, the quality of images generated has proven to be unsatisfactory due to the fact that only a fraction of the quanta released by the phosphor screen as a result of absorbed x-rays are directed by the lens to the CCD camera. Furthermore, only a fraction of the quanta directed to the CCD camera are absorbed in the CCD camera to produce electronic charge. The signal loss resulting from this secondary quantum sink has led to a corruption in the signal-to-noise ratio (SNR) and object detectability within the optical image. Increasing x-ray exposure to deal with this signal loss is not a solution due to risk to the patient.

To overcome the coupling inefficiency associated with the above-identified system, an x-ray image intensifier has been considered and is described in an article entitled "An Amorphous Selenium Liquid Crystal Light Valve For X-Ray Imaging" published in the proceedings of the International Society For Optical Engineering (SPIE) Medical Imaging 1995 conference, volume 2432, pages 228 to 234. This x-ray image intensifier includes a photoconductive x-ray detector for generating an optical image of an x-ray exposure. The photoconductive x-ray detector comprises a twisted nematic liquid crystal (LC) cell deposited on an amorphous selenium (a-Se) film. A CCD camera captures the optical image and feeds the captured optical image to a processor where the optical image is digitized and displayed.

In operation, a potential is applied across the photoconductive x-ray detector to create an electric field across the a-Se film. When x-rays pass through a patient and are absorbed in the a-Se film, electron-hole pairs are released within the a-Se film. The electric field in the a-Se film separates the electrons and the holes and guides the electrons and holes to opposite surfaces of the a-Se film with the electrons being guided towards the LC cell. The negative charges collected at the a-Se film and LC cell interface create potential variations across the LC cell. The potential variations across the LC cell give rise to changes in the orientation of the molecules of the liquid crystal material in the LC cell which affects the polarization state of light from an external source passing through the LC cell.

Polarizers on opposed sides of the photoconductive x-ray detector translate the changes in light polarization to changes in light transmission. The end result is that variations in the potential in areas of the a-Se film where x-rays are absorbed cause spatial variations in the intensity of light transmitted through the LC cell, thus producing an optical image of the x-ray exposure. The CCD camera captures the optical image allowing the processor to digitize and display the optical image. Although this x-ray image intensifier exhibits high resolution and low noise allowing quality optical images of x-ray exposures to be generated, improvements to such systems are continually being sought.

It is therefore an object of the present invention to provide a novel x-ray image intensifier and a method of x-ray imaging.

SUMMARY OF THE INVENTION

According to one aspect of the present invention there is provided an x-ray image intensifier comprising:

a photoconductive x-ray detector including a photoconductive detector layer and an electro-optic light modulator disposed on said photoconductive detector layer, said photoconductive x-ray detector absorbing x-rays passing through an object to be imaged to form an x-ray exposure of said object and generating an optical image of said x-ray exposure when light passes through said photoconductive x-ray detector;

an imager to capture optical images of said x-ray exposure; and a processor coupled to said imager to digitize and store optical images of said x-ray exposure captured by said imager at selected intervals.

Preferably, the x-ray image intensifier further includes means to display the optical images stored by the processor. The display may be in the form of a computer monitor, video cassette recorder or other suitable device. It is preferred that the optical images can be processed by the processor to form a composite optical image from selected ones of the stored optical images. It is also preferred that the photoconductive x-ray detector is dimensioned to allow large scale x-ray exposure to be formed.

In a specific embodiment, the imager is in the form of a CCD camera and the photoconductive x-ray detector includes an a-Se photoconductive detector layer and an LC cell. If desired, a phototimer can be included to provide trigger signals to the processor when the CCD camera has received sufficient light to capture an optical image. Also, a bias light to emit actinic light to bring the LC cell to the threshold of its operating characteristic may be included.

In one embodiment, a light source for generating light, which is bandpass filtered to limit the light to an non-actinic wavelength before the light passes through the photoconductive x-ray detector is included. The light source may be positioned on the same side of the photoconductive x-ray detector as the x-ray source or may be positioned on the same side of the photoconductive x-ray detector as the imager. In the later case, a reflective surface is included in the photoconductive x-ray detector to direct the light to the imager.

According to another aspect of the present invention there is provided a method of x-ray imaging comprising the steps of exposing a photoconductive x-ray detector to x-rays having passed through an object to be imaged to form an x-ray exposure of said object;

passing light through said photoconductive x-ray detector to generate an optical image of said x-ray exposure, said optical image changing over time;

capturing an optical image of said x-ray exposure at selected intervals; and digitizing and storing each captured optical image.

The present invention provides advantages in that the x-ray image intensifier has a dynamic contrast and exposure range. A single x-ray exposure of an object results in an optical image which is visible for an extended period of time after exposure. With time, the optical image changes allowing a number of optical images, each with a different characteristic, to be acquired from the single x-ray exposure. These optical images can be recombined to produce a composite optical image with a greatly enhanced exposure dynamic range. By properly timing the operation of the x-ray image intensifier, the characteristics of the x-ray image intensifier can be tailored for a given task and/or can be used for diverse imaging tasks.

The present invention also provides advantages in that the design of the x-ray image intensifier is simple making it economically attractive. Also, due to the fact that the LC cell has no individual pixel elements, the x-ray image intensifier can be easily scaled to a larger area unlike crystalline components. Furthermore, the electrostatic and non-pixelated nature of the LC cell offers better image resolution. In addition, the structural simplicity and lack of electronic components in the x-ray image intensifier helps to reduce the amount of noise allowing the signal-to-noise ratio to be kept relatively high.

BRIEF DESCRIPTION OF THE DRAWINGS

Embodiments of the present invention will now be described more fully with reference to the accompanying drawings in which.

DETAILED DESCRIPTION OF THE PREFERRED EMBODIMENTS

Figure 1:
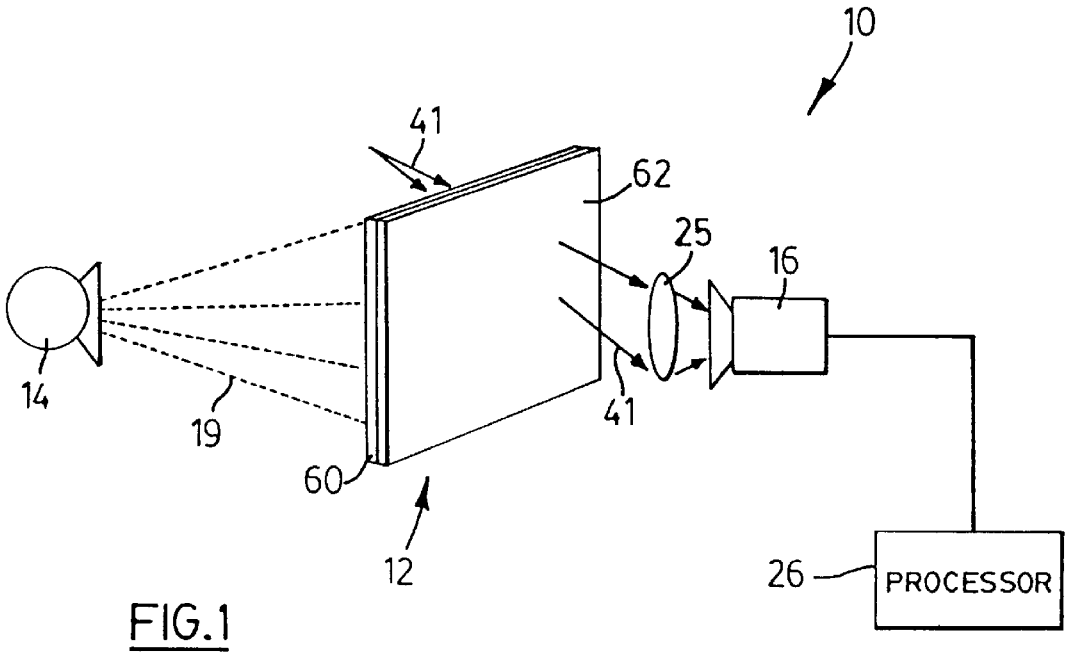
FIG. 1 is a schematic illustration of an x-ray image intensifier in accordance with the present invention.
Figure 2:
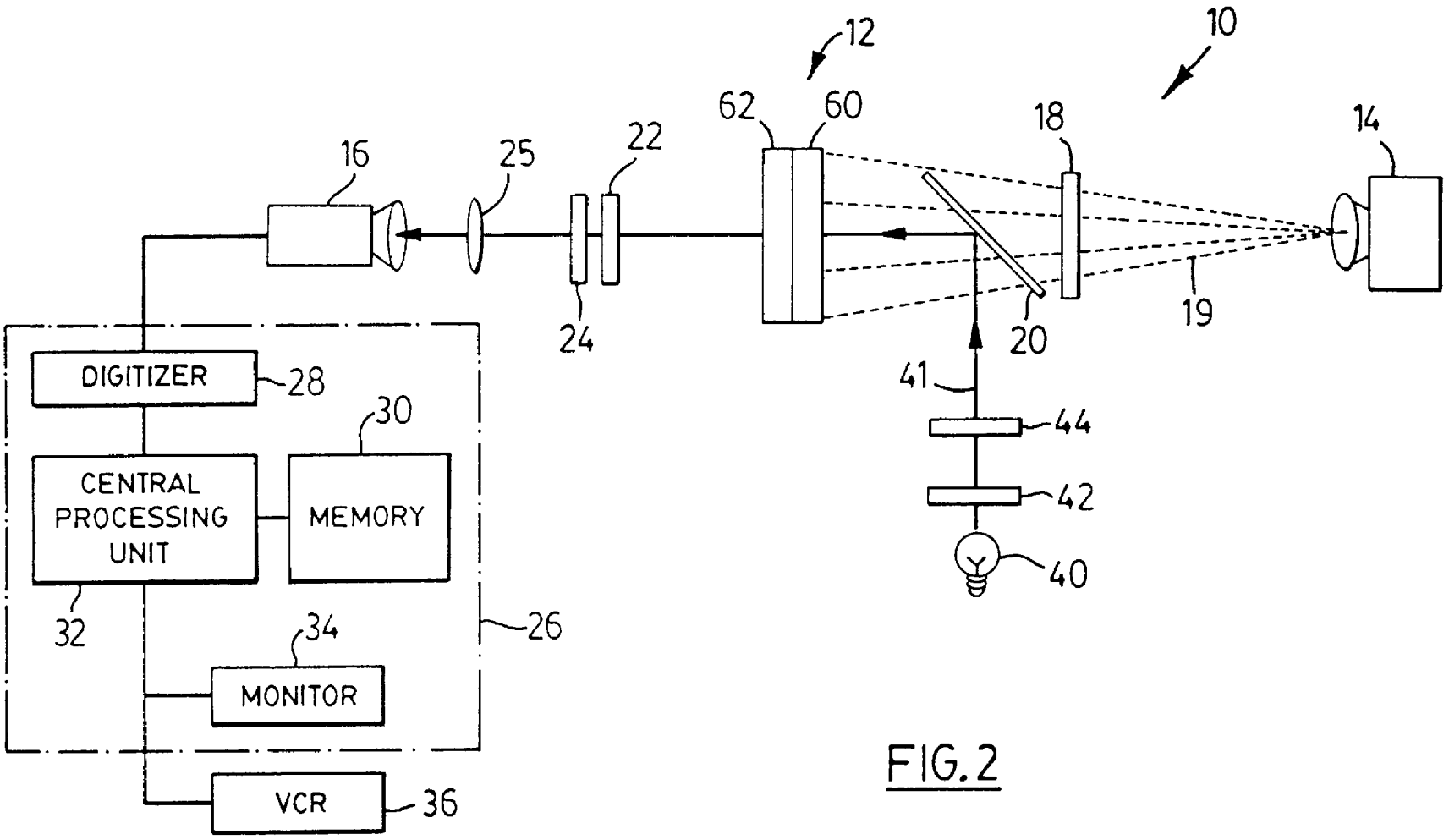
FIG. 2 is another schematic illustration of the x-ray image intensifier of FIG. 1.

Referring now to FIGS. 1 and 2, an x-ray image intensifier in accordance with the present invention is shown and is generally indicated to by reference numeral 10. The x-ray image intensifier 10 allows digitized optical images corresponding to x-ray exposure of objects such as patients to be captured. Multiple optical images resulting from a single x-ray exposure can be captured at different times allowing a number of optical images with different characteristics to be acquired. The different optical images can be recombined digitally to allow a composite to be produced with a greatly enhanced exposure dynamic range.

As can be seen, the x-ray image intensifier 10 includes a photoconductive x-ray detector 12 positioned between an x-ray source 14 and an imager in the form of a CCD camera 16. The photoconductive x-ray detector 12 is dimensioned so that an optical image of the x-ray exposure of the entire object or the desired area of interest of the object can be obtained. An object 18 to be imaged and an x-ray transparent mirror 20 are disposed between the x-ray source 14 and the photoconductive x-ray detector 12. X-rays 19 emitted by the x-ray source 14 pass through the object 18 and the mirror 20 before impinging on the photoconductive x-ray detector 12. Positioned between the photoconductive x-ray detector 12 and the CCD camera 16 is an analyzer 22 and a lens 25. Optionally, a blocking filter 24 may be positioned between the analyzer 22 and the lens 25 as shown.

A processor 26 is coupled to the CCD camera 16 and includes a digitizer 28, memory 30, a central processing unit 32 and a monitor 34. A video cassette recorder (VCR) 36 may optionally be connected to the processor 26.

A light source 40 emits light to allow optical images of x-ray exposures of the object 18 to be generated by the photoconductive x-ray detector 12. The light generated by the light source 40 passes through a bandpass filter 42 and polarizer 44 before being reflected by mirror 20 towards the photoconductive x-ray detector 12. The bandpass filter 42 allows light having a non-actinic wavelength to pass. The non-actinic light 41 passes through the photoconductive x-ray detector 12, the analyzer 22 and filter 24 if included before being de-magnified by the lens 25 and focused onto the CCD camera 16.

Figure 3:
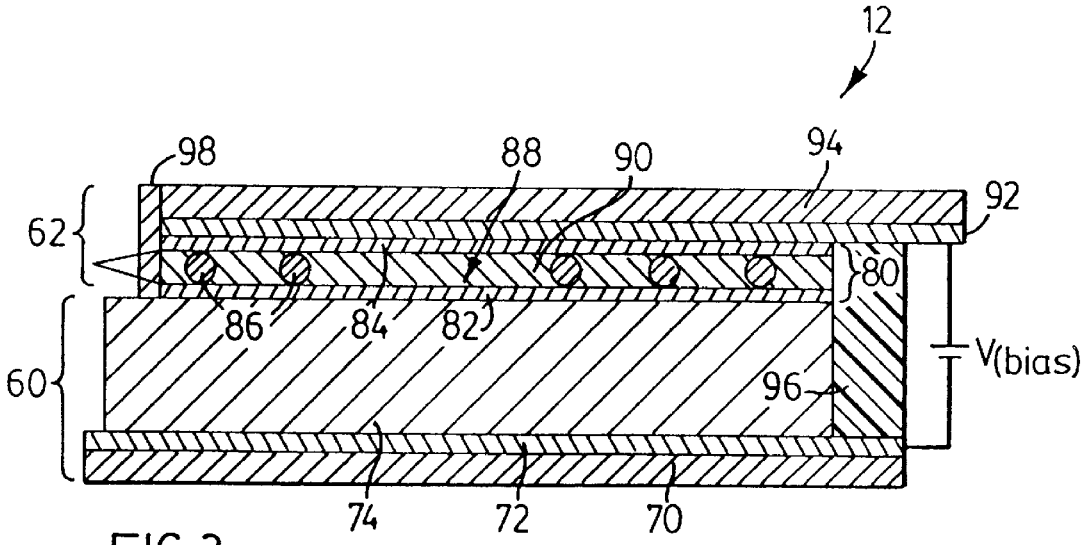
FIG. 3 is a cross-sectional view in side elevation of a photoconductive x-ray detector forming part of the x-ray image intensifier of FIG. 1.

Turning now to FIG. 3, the photoconductive x-ray detector 12 is better illustrated. As can be seen, the photoconductive x-ray detector 12 comprises an electro-optic light modulator 62 disposed on one side of a photoconductive detector layer 60. Photoconductive detector layer 60 includes a glass substrate 70 having a transparent, conductive Indium Tin Oxide (ITO) electrode 72 thereon. An amorphous-Selenium (a-Se) layer 74 having a thickness in the range of about 50 to 500 pm is deposited on the ITO electrode 72 and glass substrate 70 by thermal evaporation.

The electro-optic light modulator 62 is in the form of a 90° twisted nematic liquid crystal (LC) cell 80 having a thickness in the range of about 1 to 15 $\mu$m. The LC cell 80 includes a pair of polyimide (PI) alignment layers 82 and 84. PI alignment layer 82 is deposited on the a-Se layer 74 using spin coating techniques. Microrod spacers 86 act between the PI alignment layers to maintain a uniform separation between the PI alignment layers 82 and 84 and define an LC cavity 88. Doped nematic liquid crystal material 90 fills the LC cavity 88 and is introduced therein by a vacuum fill technique to avoid air bubble formation in the liquid crystal material. An ITO electrode 92 overlies the PI alignment layer 84 while a glass substrate 94 overlies the ITO electrode 92. The ITO electrode 92 and the glass substrate 94 overhang the photoconductive detector layer 60 to facilitate connection of a potential source V(bias) between the ITO electrodes 92 and 72 respectively.

The LC cell 80 is constructed in a similar manner to self-standing LC cells with the exception that the LC cell is defined by a glass substrate and an a-Se layer as opposed to a pair of glass substrates. Also, the PI alignment layers 82 and 84 are cured at a low temperature to maintain the temperature below 65° C. and thereby avoid recrystallization within the a-Se layer 74. As is known, recrystallization of a-Se drastically increases dark current. To compensate for the low temperature curing, the PI alignment layers 82 and 84 are cured for a long time (at least a few hours) in an evacuated oven.

Epoxy 96 acts between the ITO electrodes 92 and 72 to fill areas between the ITO electrodes separated by air and inhibit breakdown of the LC cell 80 when a potential is placed across the ITO electrodes. Epoxy 98 also seals the electro-optic light modulator 58 to inhibit separation of the layers forming the photoconductive x-ray detector 12.

Figure 4:
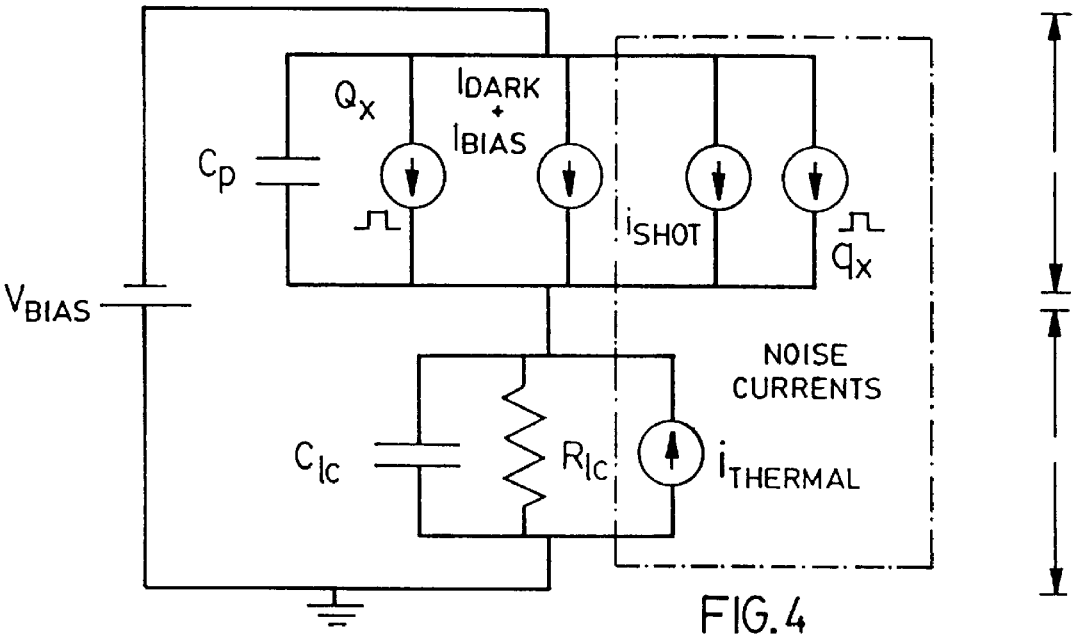
FIG. 4 is a schematic of an equivalent electrical circuit of the photoconductive x-ray detector of FIG. 3.

FIG. 4 illustrates an equivalent electrical circuit of the photoconductive x-ray detector 12. As can be seen, the photoconductive detector layer 60 can be represented by a capacitor $C_p$ and a number of current and charge sources all connected in parallel. The LC cell 80 can be represented by a capacitor $C_{le}$, a resistor $R_{lc}$ and a current source all connected in parallel.

In operation, the object 18 to be imaged is placed between the x-ray source 14 and the photoconductive x-ray detector 12. The x-ray source 14 is then operated to emit x-rays 19 which pass through the object 18 and mirror 20 and impinge on the photoconductive detector layer 60. The photoconductive detector layer 60 in turn absorbs the x-rays 19. Once the object 18 has been exposed to the x-rays 19 for a time sufficient to generate the desired optical image, the x-ray source 14 is turned off.

To sensitize the photoconductive x-ray detector 12 to x-rays, the potential source V(bias) is conditioned to apply a potential between the ITO electrodes 72 and 92 during x-ray exposure which in turn creates an electric field across the a-Se layer 74. When incident x-rays 19 passing through the object 18 contact the photoconductive detector layer 60, the x-rays are absorbed in the a-Se layer 74 causing electron-hole pairs to be released. The electric field created in the a-Se layer 74 guides the holes and electrons to opposite surfaces of the a-Se layer with the electrons being guided towards the surface adjacent the LC cell 80, thereby resulting in charges collecting at the interface between the a-Se layer 74 and the LC cell 80. The electric field ensures that there is very little lateral spread in charge movement within the a-Se layer 74 so that the collected charges faithfully reproduce the pattern of x-rays absorbed by the a-Se layer across its entire surface.

The charges collected at the interface between the a-Se layer 74 and the LC cell 80 give rise to an electric potential across the LC cell which affects the orientation of the molecules of the liquid crystal material 90. This in turn affects the polarization state of non-actinic light passing through the photoconductive x-ray detector 12.

When it is desired to capture an optical image of the x-ray exposure of the object 18, the light source 40 is operated to emit light. The light is filtered by bandpass filter 42 so that only non-actinic light 41 (i.e. light which is not absorbed by the photoconductor detector layer 60) is directed to the polarizer 44. The non-actinic light 41 passes through the polarizer 44 before being reflected by the mirror 20 towards the photoconductive x-ray detector 12. The non-actinic light in turn passes through the photoconductive x-ray detector.

The light emerging from the photoconductive x-ray detector 12 passes through the analyzer 22 and filter 24 if included and is then de-magnified and focused by lens 25 onto the CCD camera 16. The polarizer 44 and analyzer 22 translate changes in light polarization of the non-actinic light as it passes through the photoconductive x-ray detector 12 to changes in light transmission. The end result is that variations in the potential across the LC cell 80 adjacent areas of the a-Se layer 74 where x-rays are absorbed cause spatial variations in the intensity of the non-actinic light transmitted through the photoconductive x-ray detector. Thus, an optical image of the x-ray exposure is created. By changing the intensity of the light generated by the light source 40, the brightness of the optical image can be changed independent of x-ray exposure.

The light focused onto the CCD camera 16 by the lens 25 is absorbed by the CCD camera so that an optical image of the x-ray exposure in the form of an electronic charge is captured. The processor 26 is programmed to download the optical image captured by the CCD camera 16. The downloaded optical image is then digitized and stored in memory 30. The optical image can then be displayed via the monitor 34 or recorded on tape by way of the VCR 36.

Figure 5A:
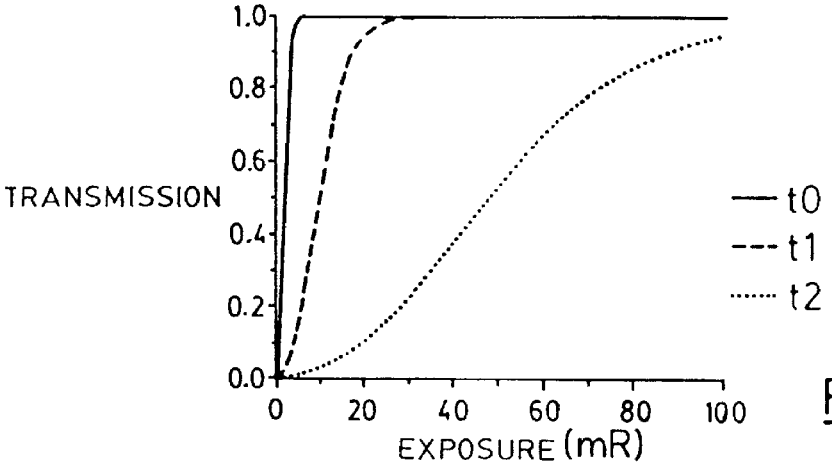
FIG. 5*a* is a transmission versus exposure characteristic curve of the photoconductive x-ray detector of FIG. 3.

The processor 26 downloads optical images from the CCD camera 16 in a manner so that the x-ray image intensifier 10 is operated in a dynamic mode to allow the characteristic curve of the photoconductive x-ray detector 12 to be customized. The dynamic mode of operation of the x-ray image intensifier 10 is based on the time dependence of the charges collected at the interface between the a-Se layer 74 and the LC cell 80. As described above, the collected charges, which give rise to the potential Vo across the LC cell, result in an optical image of the x-ray exposure being generated when non-actinic light passes through the photoconductive x-ray detector 12. With time, the collected charges discharge through the LC cell 80 and the potential Vo decays. The decay of the potential is exponential and is governed by a time constant defined by the physical characteristics of the liquid crystal material 90 in the LC cell, namely its resistance $R_{lc}$ and capacitance $C_k$. Since the transmission of light through the LC cell 80 is a function of the potential Vo, the decay of the potential results in a gray-scale that is time dependent. The optical response of the photoconductive x/ray detector 12 is shown in FIG. 5*a*. As can be seen, the characteristic curve of the photoconductive x-ray detector 12 changes with time.

Figure 6:
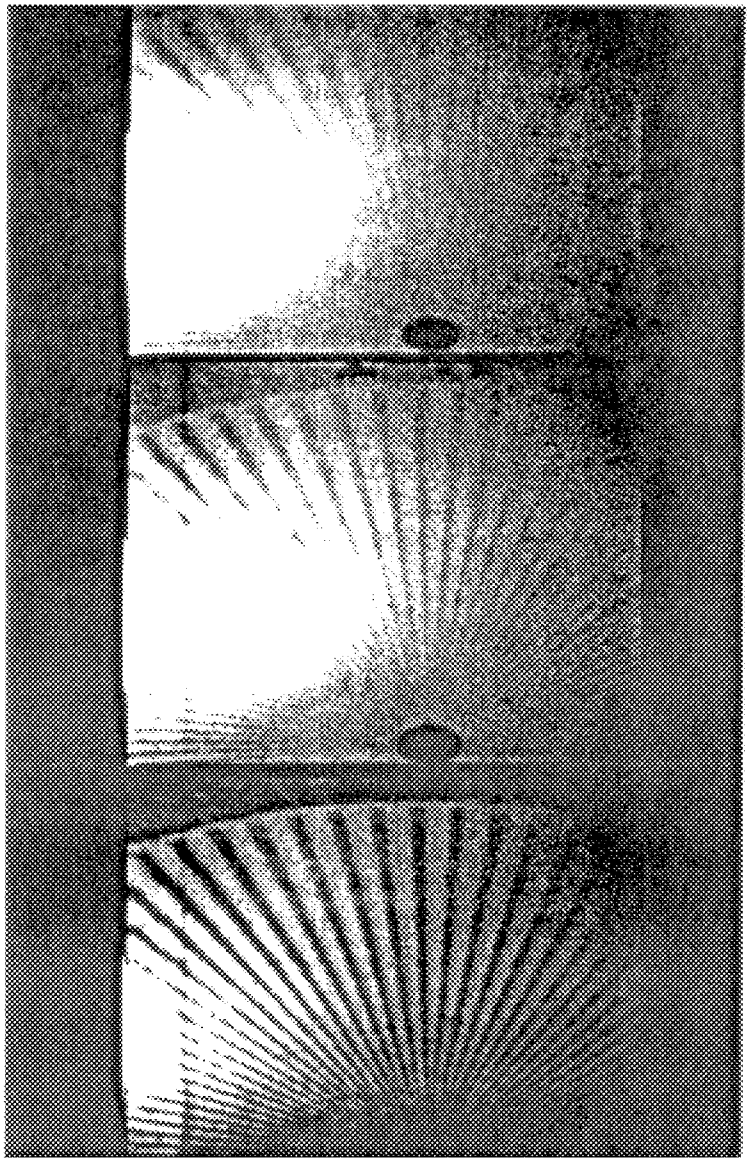
FIG. 6 illustrates optical images taken at selected intervals by the x-ray image intensifier of FIG. 1, of a single x-ray exposure of an object.

Specifically, the processor 26 downloads optical images captured by the CCD camera 16 at selected intervals after a single x-ray exposure of the object 18 has occurred so that a series of images of the object 18 are taken, each with a different transmission versus exposure characteristic. This makes the x-ray image intensifier 10 extremely flexible allowing the x-ray image intensifier to be used for various imaging tasks. In the case of radiographic imaging of patients, a series of optical images, each of which presents the same anatomy with a different contrast can be taken without subjecting the patient either to an increase in the dose of radiation or to an increase in exposure time. FIG. 6 illustrates a series of successive optical images of an object taken at selected intervals following a single x-ray exposure of about 100 mR. As can be seen, the appearance of the optical images changes over time. The digitized optical images can be processed by the central processing unit 32 to form a composite optical image with an enhanced contrast.

Alternatively, a selected optical image with a specific mapping between transmission and exposure can be retrieved from the memory 30. In either case, the composite optical image or selected optical image can be displayed on the monitor 34 or recorded on tape via VCR 36.

Figure 5B:
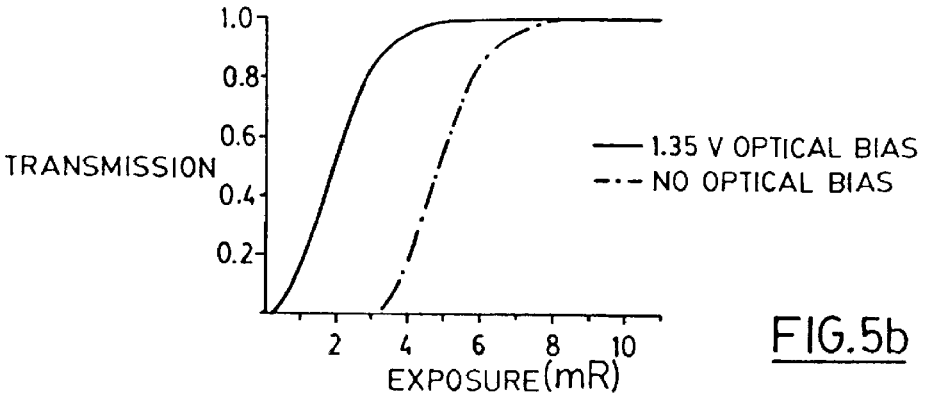
FIG. 5*b* is another transmission versus exposure characteristic curve of the photoconductive x-ray detector of FIG. 3.

If desired, a bias light which emits actinic light can be used in the x-ray image intensifier 10. In this case, the bias light is operated to emit actinic light prior to exposure of the object 18 to x-rays. The actinic light is absorbed by the photoconductive x-ray detector 12. This results in a potential being created in the photoconductive detector layer 60 which brings the LC cell 80 to the threshold of its operating characteristic so that x-ray exposure results in good contrast. The bias light can be operated continuously to give rise to a DC current and steady LC cell bias or can be pulsed to give rise to a current pulse and a decaying LC cell bias. FIG. 5*b* illustrates the optical response of the photoconductive x-ray detector 12 with changes in the optical bias.

Alternatively, the initial bias applied across the photoconductive x-ray detector 12 by the potential source V(bias) can be changed to alter the characteristics of the x-ray image intensifier 10. Changing the bias applied across the photoconductive x-ray detector affects the gain of the photoconductive detector layer due to the fact that the number of charges released in the a-Se layer per x-ray is dependent on the electric field in the a-Se layer 74. This of course affects the slope of the characteristic curve.

Although not shown, a phototimer can be positioned adjacent the CCD camera 16 to provide a trigger signal to the processor 26 when sufficient light has been collected by the CCD camera 16 to result in a satisfactory optical image. In this case, the processor 26 downloads optical images captured by the CCD camera in responsive to trigger signals generated by the phototimer.

Once the optical images have been captured, digitized and stored, the polarity of the potential voltage source V(bias) is switched to reverse the bias applied across the ITO electrodes 92 and 72 for the same duration the ITO electrodes were biased during x-ray exposure. Reversing the bias applied across the ITO electrodes removes ions collected on the PI alignment layers 82 and 84 which may cause damage if not removed.

As will be appreciated by those of skill in the art, the x-ray image intensifier 10 has a dynamic contrast and exposure range whose characteristics can be tailored for a given task. Since the x-ray image intensifier makes use of an amorphous selenium photoconductor, a large area photoconductive x-ray detector 12 designed for the anatomy to be imaged can be created in a practical and economic manner. This is not possible with crystalline photoconductors which can only be grown to produce small surface areas. The x-ray image intensifier 10 is particularly suited to capturing optical images for use in diagnostic radiography or for portal imaging. Portal imaging refers to the verification optical image during radiation treatment.

Figure 7:
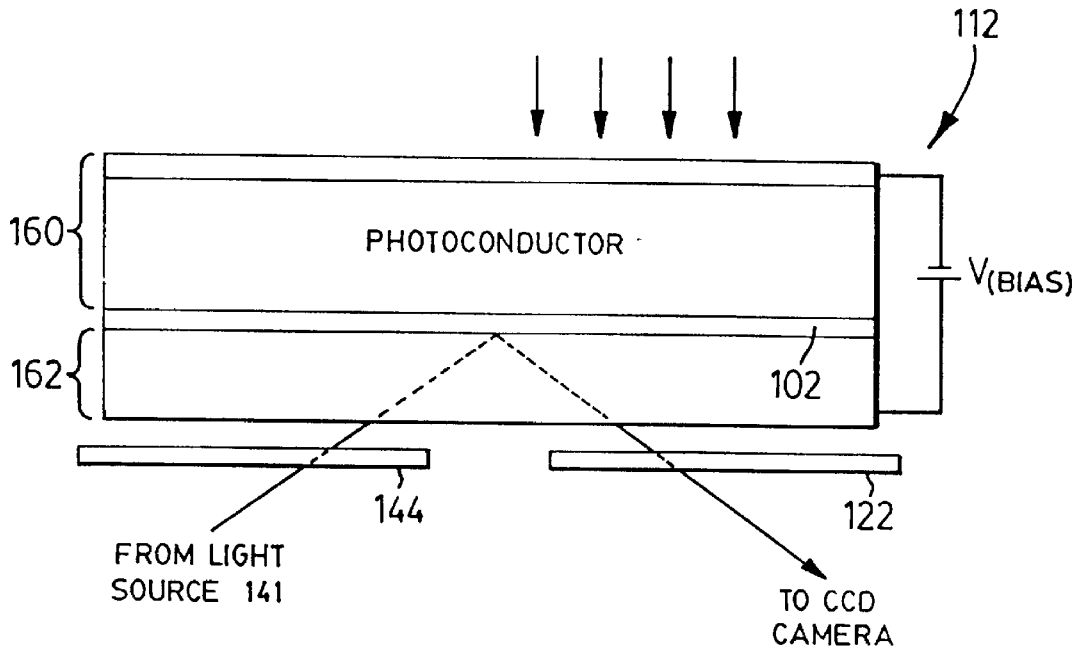
FIG. 7 is a side elevational view of another embodiment of a photoconductive x-ray detector for an x-ray image intensifier in accordance with the present invention.

Referring now to FIG. 7, another embodiment of a photoconductive x-ray detector for use in the x-ray image intensifier 10 is shown. In this embodiment, like reference numerals will be used to indicate like components of the first embodiment with a "100" added for clarity. As can be seen, in this case, the light source 140 is located on the same side of the photoconductive x-ray detector 112 as the CCD camera. A mirror 102 is included in the photoconductive x-ray detector 112 and is positioned between the photoconductive detector layer 160 and the LC cell 180. The polarizer 144 and analyzer 122 are laterally spaced and are positioned adjacent the LC cell 180.

After an x-ray exposure of an object has been taken, the light source 140 is operated to emit light which is bandpass filtered. The non-actinic light 141 which passes through the bandpass filter also passes through the polarizer 144 and then through the LC cell 180 before being reflected by the mirror 102. The reflected light then passes back through the LC cell 180 and through the analyzer 122. The light passing through the analyzer 122 is collected by the CCD camera in the manner previously described. Although the mirror 102 is shown sandwiched between the photoconductive detector layer 160 and the LC cell 180, if desired, the mirror may be defined by the surface of the a-Se layer 174 adjacent the LC cell 180.

Figure 8:
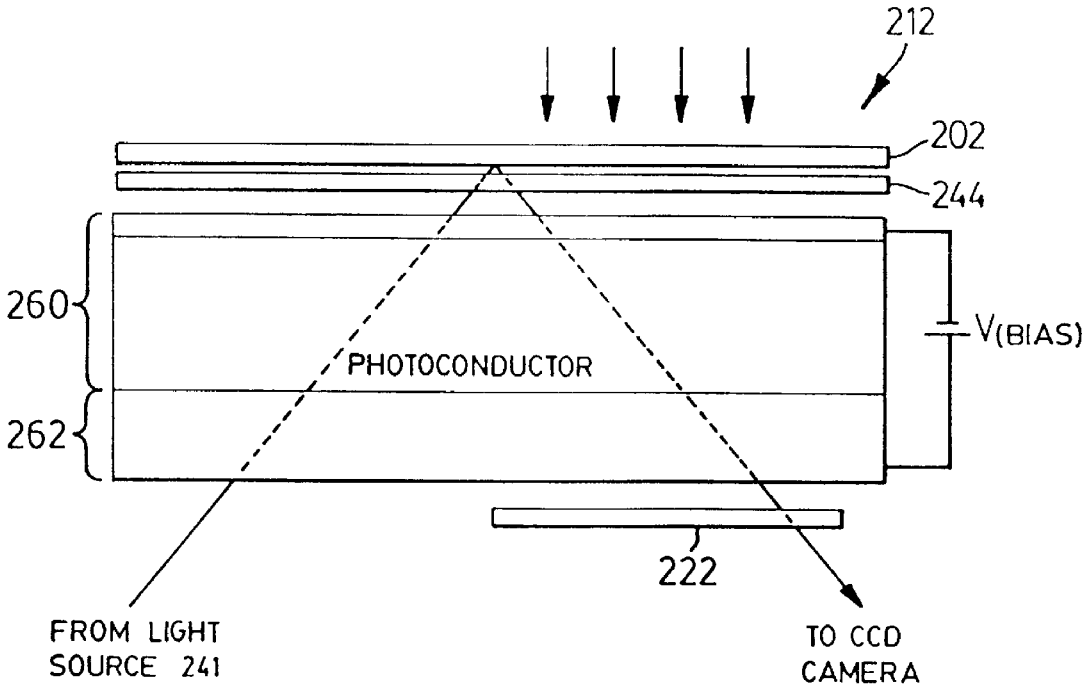
FIG. 8 is a side elevational view of yet another embodiment of a photoconductive x-ray detector for an x-ray image intensifier in accordance with the present invention.

FIG. 8 shows yet another embodiment of a photoconductive x-ray detector for use in the x-ray image intensifier 10. In this embodiment, like reference numerals will be used to indicate like components of the first embodiment with a "200" added for clarity. Similar to the previous embodiment, the light source 240 is located on the same side of the photoconductive x-ray detector 212 as the CCD camera. However, in the case, a mirror 202 is positioned between the x-ray source and the photoconductive x-ray detector 212. Polarizer 24 is disposed between the mirror 202 and the photoconductive x-ray detector.

Although the x-ray image intensifier has been described as including an electro-optic light modulator 60 in the form of a twisted nematic LC cell, it should be appreciated that other types of LC cells or other suitable electro-optic light modulators may be used. Also, although the photoconductive detector layer has been described as including an a-Se layer, those of skill in the art will appreciate that other photoconductive material may be used.

Although the imager has been described as being in the form of a CCD camera, other imagers such as for example, light sensitive matrices or photodiode arrays may be used. Also, if desired an array of imagers, each with an associated lens can be used to collect light passing through the photoconductive x-ray detector and capture optical images. In this case, the optical images captured by the imagers in the array are downloaded to the processor. Furthermore, the lens or lenses may be replaced with another type of optical coupler such as fibre optic.

It will be appreciated by those of skill in the art that other variations and modifications may be made to the present invention without departing from the spirit and scope thereof as defined by the appended claims.

We claim:

1. An x-ray image intensifier comprising:

a photoconductive x-ray detector including a photoconductive detector layer and an electro-optic light modulator disposed on said photoconductive detector layer, said photoconductive x-ray detector absorbing x-rays passing through an object to be imaged and creating variations in potential across said electro-optic modulator thereby to form an x-ray exposure of said object, said variations in potential decaying over time;

a source of non-actinic light to pass through said photoconductive x-ray detector after said x-ray exposure has been formed, said variations in potential causing spatial variations in the intensity of said non-actinic light thereby to create an optical representation of said x-ray exposure;

an imager receiving said non-actinic light after having passed through said photoconductive x-ray detector and capturing images of said x-ray exposure at selected intervals thereby to capture multiple images of the same x-ray exposure at different times, each of said images having a different transmission versus exposure characteristic; and a processor coupled to said imager to digitize and store said images.

2. An x-ray image intensifier as defined in claim 1 further including a display to display said images stored by said processor.

3. An x-ray image intensifier as defined in claim 2 wherein said processor is operable to generate a composite image from selected ones of said images stored therein.

4. An x-ray image intensifier as defined in claim 2 wherein said processor is operable to select an image stored therein having a desired transmission versus exposure characteristic.

5. An x-ray image intensifier as defined in claim 1 wherein said photoconductive x-ray detector is dimensioned to allow large scale x-ray exposure to be formed.

6. An x-ray image intensifier as defined in claim 1 wherein said imager is in the form of at least one imaging device and wherein an associated optical coupler is disposed between said at least one imaging device and said photoconductive x-ray detector to de-magnify and focus said non-actinic light onto said at least one imaging device.

7. An x-ray image intensifier as defined in claim 6 wherein said at least one imaging device is in the form of a CCD camera and wherein said associated optical coupler is in the form of a lens.

8. An x-ray image intensifier as defined in claim 6 wherein said imager includes an array of imaging devices and an optical coupler associated with each imaging device.

9. An x-ray image intensifier as defined in claim 7 further including a phototimer providing trigger signals to said processor when said CCD camera has received sufficient light to capture an image, said processor digitizing and storing said images in response to said trigger signals.

10. An x-ray image intensifier as defined in claim 1 further including a bias light to emit actinic light onto said photoconductive x-ray detector prior to formation of said x-ray exposure, said actinic light bringing said electro-optic light modulator to the threshold of its operating characteristic.

11. An x-ray image intensifier as defined in claim 1 wherein a potential applied across said photoconductive x-ray detector is adjustable to alter the gain of said photoconductive x-ray detector.

12. An x-ray image intensifier as defined in claim 1 wherein said non-actinic light is generated by a light source positioned on the same side of the photoconductive x-ray detector as a source of said x-rays.

13. An x-ray image intensifier as defined in claim 1 wherein said non-actinic light is generated by a light source positioned on the same side of the photoconductive x-ray detector as said imager, said photoconductive x-ray detector further including a reflective surface therein to direct said non-actinic light to said imager.

14. An x-ray image intensifier as defined in claim 13 wherein said reflective surface is defined by a surface of said photoconductive detector layer.

15. An x-ray image intensifier as defined in claim 13 wherein said reflective surface is defined by a mirror positioned between said photoconductive detector layer and said electro-optic light modulator.

16. An x-ray image intensifier as defined in claim 13 wherein said reflective surface is defined by a mirror disposed on said photoconductive detector layer.

17. An x-ray image intensifier as defined in claim 1 wherein said photoconductive detector layer is in the form of an a-Se layer and wherein said electro-optic light modulator is in the form of a liquid crystal cell.

18. An x-ray image intensifier as defined in claim 17 wherein said LC cell is of the twisted nematic type.

19. An apparatus for generating x-ray images of an object comprising:

an x-ray source to generate x-rays to pass through an object to be imaged;

a photoconductive x-ray detector including a photoconductive detector layer and an electro-optic light modulator disposed on said photoconductive detector layer, said photoconductive x-ray detector absorbing x-rays having passed through said object, said absorbed x-rays creating variations in potential across said electro-optic modulator adjacent the interface between said electro-optic modulator and said photoconductive detector layer thereby to form an x-ray exposure of said object, said variations in potential decaying over time;

a source of non-actinic light to pass through said photoconductive x-ray detector after said x-ray exposure has been formed, said variations in potential causing spatial variations in the intensity of said non-actinic light thereby to create an optical representation of said x-ray exposure;

an imager receiving said non-actinic after having passed through said photoconductive x-ray detector and capturing images of said x-ray exposure at selected intervals thereby to capture multiple images of the same x-ray exposure at different times, each of said images having a different transmission versus exposure characteristic; and a processor coupled to said imager to digitize and store said optical images captured by said imager.

20. An apparatus as defined in claim 19 wherein said processor generates a composite image from selected ones of said images stored therein.

21. An apparatus as defined in claim 19 wherein said processor is responsive to user input to select an image stored therein having a desired transmission versus exposure characteristic.

22. An apparatus as defined in claim 19 wherein said photoconductive detector layer is in the form of an a-Se layer and wherein said electro-optic light modulator is in the form of a liquid crystal cell.

* * * * *